US006418904B2

(12) United States Patent
Hannon et al.

(10) Patent No.: US 6,418,904 B2
(45) Date of Patent: Jul. 16, 2002

(54) PULSE DRIVE VALVE DEACTIVATOR

(75) Inventors: Mark S. Hannon, South Lyon; Arthur J. Spohn, Sterling Heights; James R. Klotz, Mt. Clemens, all of MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/824,979

(22) Filed: Apr. 3, 2001

Related U.S. Application Data

(60) Provisional application No. 60/194,558, filed on Apr. 3, 2000.

(51) Int. Cl.[7] ..... F02B 77/00
(52) U.S. Cl. ..... 123/198 F; 123/90.16
(58) Field of Search ..... 123/198 F, 90.16

(56) References Cited

U.S. PATENT DOCUMENTS 4,576,128 A 3/1986 Kenichi
5,549,081 A 8/1996 Ohlendorf et al.
5,553,584 A 9/1996 Konno
5,592,907 A 1/1997 Hasebe et al.
5,613,469 A 3/1997 Rygiel
5,653,198 A 8/1997 Diggs
5,660,153 A 8/1997 Hampton et al.
5,697,333 A 12/1997 Church et al.
5,893,344 A 4/1999 Church
5,908,015 A 6/1999 Kreuter
5,924,396 A 7/1999 Ochiai et al.
5,960,756 A 10/1999 Miyachi et al.
6,006,706 A 12/1999 Kanzaki
6,032,624 A 3/2000 Tsuruta et al.
6,092,497 A 7/2000 Preston et al.

*Primary Examiner*—Noah P. Kamen
(74) *Attorney, Agent, or Firm*—Ralph E. Smith

(57) ABSTRACT

A valve deactivator is provided that is capable of being activated and deactivated by a pulse energy input. The valve deactivator includes an input member and an output member which are movable relative to one another in the deactivated mode and which are engaged for simultaneous movement in an activated mode. A coil and armature, or other pulse energy input means, are provided to engage and disengage a locking system to activate and deactivate the valve actuator.

13 Claims, 7 Drawing Sheets

13
9A
1
9
8
1
15
7
24
19
15A
25
12
4
11
19
10
14
20
22
26
3
23
4
17
16
18
21
5
19A
2
6
2
14A

PULSE DRIVE VALVE DEACTIVATOR

CROSS-REFERENCE TO RELATED APPLICATIONS

This application claims the benefit of U.S. Provisional Application Serial No. 60/194,558 filed Apr. 3, 2000. The disclosure of which is incorporated herein by reference.

FIELD OF THE INVENTION

The present invention relates to an electromagnetically or hydraulic actuated pulse driven two position ratchet mechanism for valve deactivation in push rod and overhead camshaft internal combustion engines. This pulse system can be adapted to a push rod configuration, or at a rocker location of an overhead camshaft valve drive. For improved fuel economy strategic cylinders would be deactivated by inducing a break in the valve drive linkage using a time sensitive switching device activated by an energy conserving pulse versus the continuous power on versions.

DESCRIPTION OF RELATED ART

Traditionally, valve deactivation devices are complex designs employing a remote located solenoid using a drive linkage which is held to the on position by a continuous energy draw to a solenoid coil, or continuous hydraulic pressure. Valve deactivation systems (VDS) date back to the early 1970s. The first successful system was a latchable fulcrum for pushrod rocker arms on Cadillac V8 engines in 1981. Further present day valve deactivation system examples are those of INA Motor Enelment uses a 3 lobe camshaft, dual bucket configuration for overhead camshaft engines wherein a high lift/no lift event is achieved by driving the outer bucket with the higher profile peripheral camshaft lobes for high lift, and driving the central camshaft lobe and bucket for no lift. This system employs a sliding hydraulic operating pin, which switches to connect outer bucket to inner bucket to generate, timed lift event. Another INA design uses a two-piece valve rocker where the primary rocker section driven by the camshaft is connected or disconnected to a secondary rocker activating the valve by a sliding pin. It should be appreciated that all valve deactivation systems need a power supply, and a driven switching engagement element such as a pin, which is very critical to operation. The reason for this preciseness is you only have the rest time, or camshaft base circle time when the valvetrain rockers and pushrods are not in motion for insertion of a locking pin or switching element. It also should be noted that the switching sequence time decreases, as engine RPM becomes higher. Therefore, it is an advantage to use a time compatible geometry for switching element.

SUMMARY OF THE INVENTION

The present invention provides a compact concentrically located solenoid drawing a short energy pulse to drive a ratcheted geometric switching key to join or detach adjacent moving valvetrain elements. A significant feature of this design is its fast, direct solenoid reaction time, and specialized rotative locking key which moves at the same velocity as the retaining member it is locked to for valve deactivation.

It is therefore a primary object of this invention to provide a specialized locking key which, unlike a pin or latch, when driven will provide superior performance within camshaft base circle diameter time window.

It is another object of this invention to locate the driving armature close to the locking key to lower the mass of the connecting members needed to switch the locking key for faster operation.

It is yet another object of this invention to design a solenoid concentrically to delete remote connecting members, simplify design, and lower drive members for fast reaction time.

It is still another object of this invention to drive the locking key to an engaged position with one energy pulse.

It is yet another object of this invention to combine the solenoid locking system and tappet in one compact assembly for push rod application.

It is a further object of this invention to be adaptable for location high in a cylinder head for easy service.

It is still a further object of this invention to adapt the solenoid and locking key assembly to a primary and secondary rocker for valve deactivation on overhead camshaft engines.

To achieve the foregoing objects, the present invention provides an electromagnetically pulse driven two-position specialized ratchet mechanism for valve deactivation. One advantage of the present invention is a low mass special key for faster response is used operating in camshaft base circle diameter time window.

Another advantage of the present invention is that the driving armature can be located very close to the switching key for fast activation.

A further advantage of the present invention is that the solenoid is designed concentrically creating a compact unit deleting the need for remote connecting elements.

A further advantage of the present invention is that the locking key is driven to the engaged position by one pulse, thus conserving the energy needed to activate versus continuously applied versions.

Still another advantage of the present invention is that the activation unit can be adapted to both push rod and overhead camshaft engines.

Yet still another advantage of the present invention is that the electro solenoid system does not contend with the low RPM oil pressure, and oil pump energy draw of hydraulic systems.

Another advantage of the present invention is that the locking key has more latitude in build tolerancing.

Other features and advantages of the present invention will be readily appreciated, as the same becomes better understood after reading the subsequent description taken in conjunction with the accompanying drawings.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
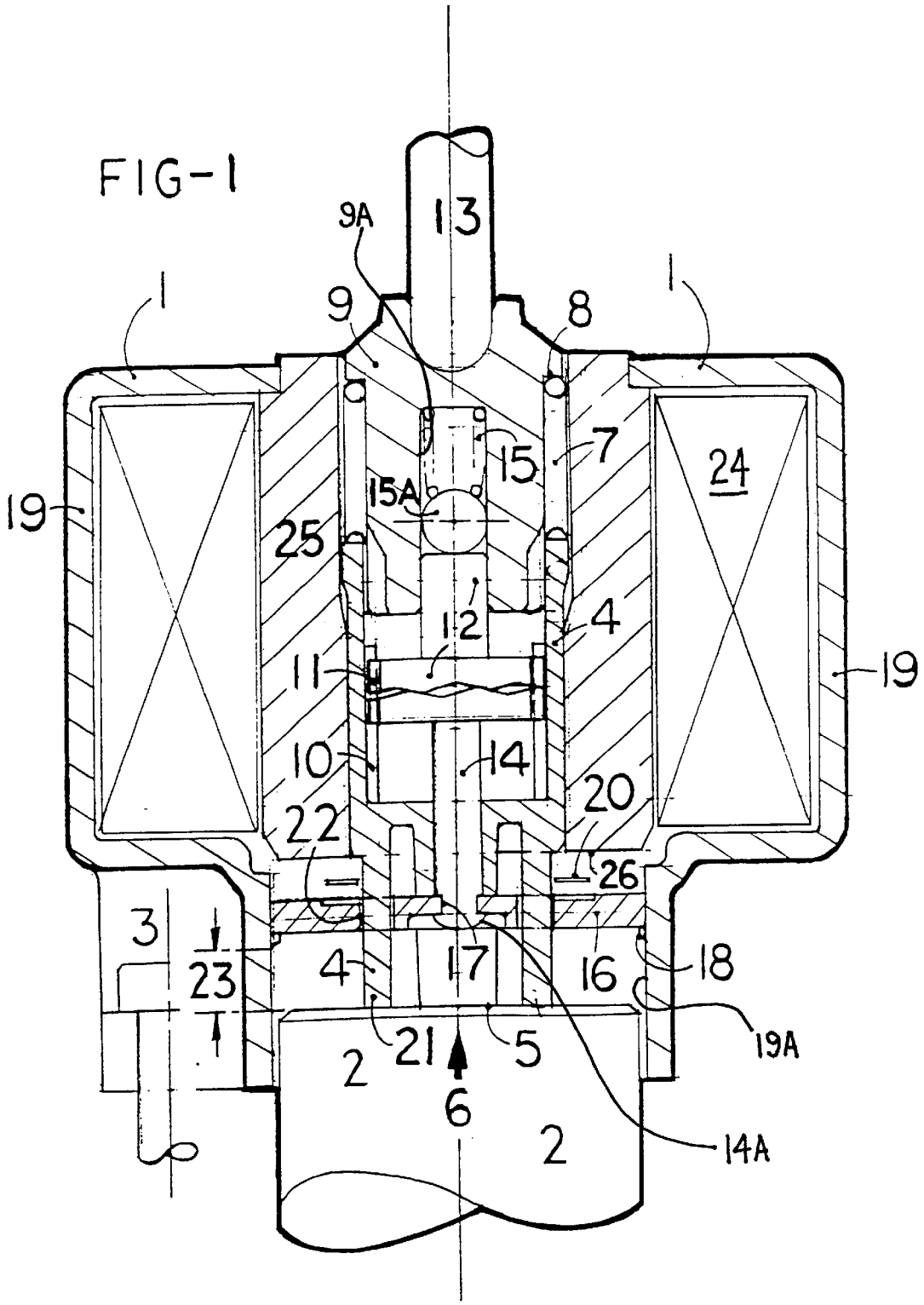
FIG. 1 is a cross section of a pulse drive valve deactivator, according to the principles of the present invention.

With reference to FIG. 1, the pulse drive valve deactivator 1 of the present invention is shown as a compact unit mounting over tappet 2. The pulse drive valve deactivator can be utilized for present production engines or integrated into a tappet for new engine applications. The valve deactivator 1 is illustrated to be mounted in position by fastener 3 abutting the key drive retainer 4 adjacent the tappet 2 at surface 5. As the camshaft (not shown) rotates, tappet 2 moves in the direction of arrow "6" driving the key drive retainer 4 which compresses lost motion spring 7 against surface 8 of push rod retaining socket 9.

Push rod retaining socket 9 is held immobile by push rod 13. The valve spring (not shown) acting upon the push rod 13 has a higher spring constant than the spring constant of lost motion spring 7. As key drive retainer 4 moves in an unlocked mode, channel 10 slides along lugs 11 of stationary positioned locking key 12. Locking key 12 is loaded against key driver 14 by spring 15 and pivot ball 15A which are received in a central bore 9A of the push rod retaining socket 9. Key driver 14 is joined to armature 16 at opening 17 which receives a head portion 14A of the key driver 14. Armature 16 is held against a stop 18 extending from an internal wall 19A of solenoid frame 19 by a wave spring 20.

Figure 2:
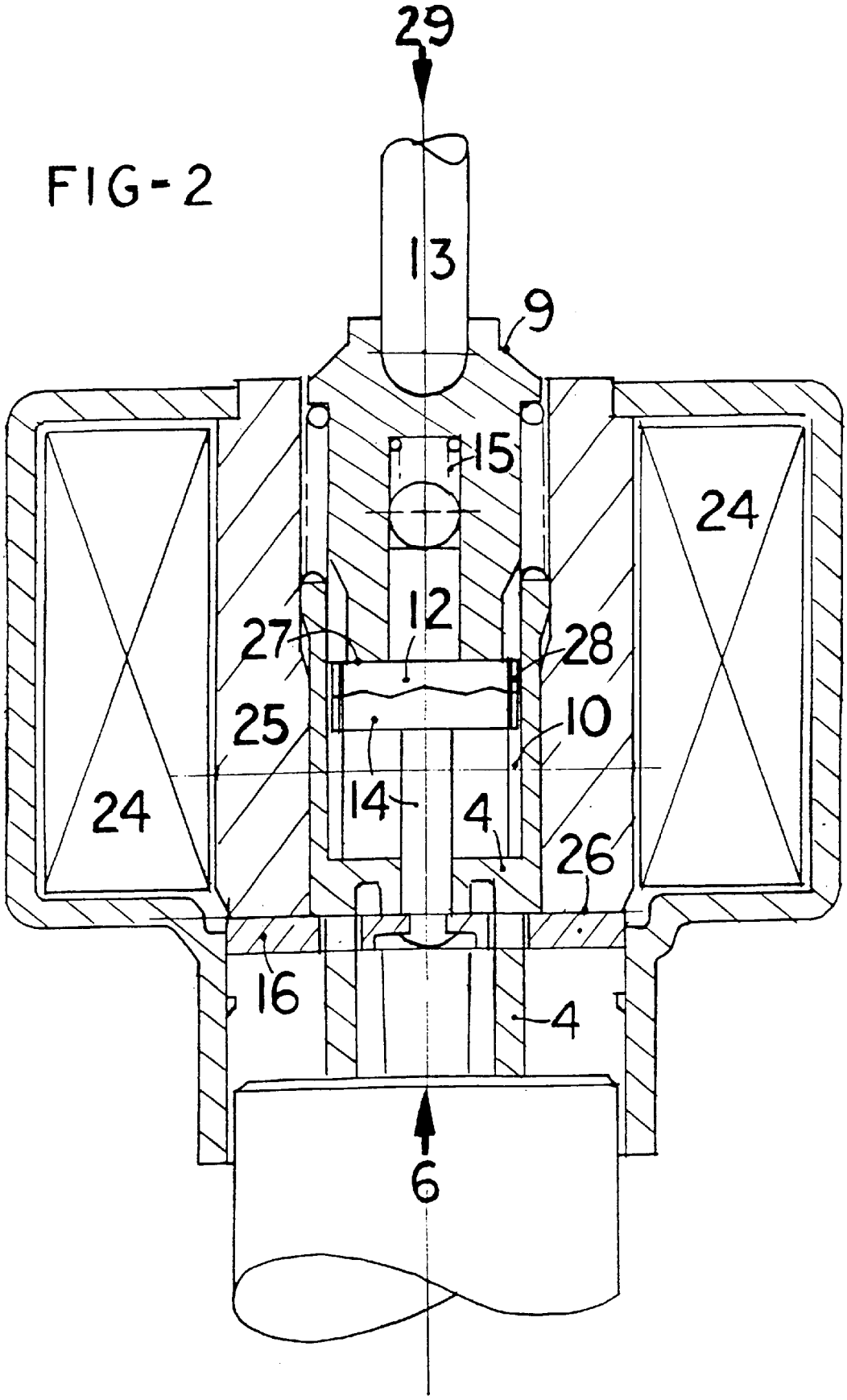
FIG. 2 is a cross section of the pulse drive valve deactivator showing the solenoid armature in a locking mode.

Key drive retainer 4 employs fingered projections 21 working through windows 22 provided in the armature 16 for connection to the tappet 2. It should be appreciated that in an unlocked mode only tappet 2 and key drive retainer 4 compressing lost motion spring 7 against surface 8 of push rod retaining socket 9 are moving as the camshaft (not shown) turns. Tappet 2 needs a diameter lift distance "23" (best shown in FIG. 1) to work in. Referring to FIG. 2, push rod 13 is activated during the time cycle at the beginning of the compression stroke, and the end of the power stroke when the valves are closed, and the valvetrain is at rest. During this period, coil 24 is energized from a power supply creating a magnetic field attracting the armature 16 toward the core 25 at surface 26. Movement of the armature 16 drives the key driver 14, thus propelling the locking key 12 along the channel 10 and thereby compressing spring 15 (shown compressed in FIG. 2). As the locking key 12 is propelled toward the surface 27 of push rod retaining socket 9, locking key 12 is joined to key drive retainer 4 at the connecting juncture position 28. The locking key 12 drives the push rod retaining socket 9 driving the push rod 13 activating the valve (not shown). It should be noted that when push rod 13 is driven in the direction of arrow "6," the locking key 12 is compressed between surface 27 and connecting juncture 28 holding that locked position. When the valve spring thrusts the rocker (not shown) and push rod 13 in the direction of arrow "29," the inertia of the locking key 12 and spring 15 are working in conjunction to keep the locking key 12 at a connection juncture 28 until the camshaft base circle time zone is reached wherein only spring 15 keeps locking key 12 seated.

During the camshaft base circle time period the solenoid is energized driving the locking key 12 to compress spring 15 and index the locking key 12 to the unlocked mode.

It should be appreciated that during this event, the locking key 12 moves rotatively at the same velocity as key drive retainer 4.

Figure 3:
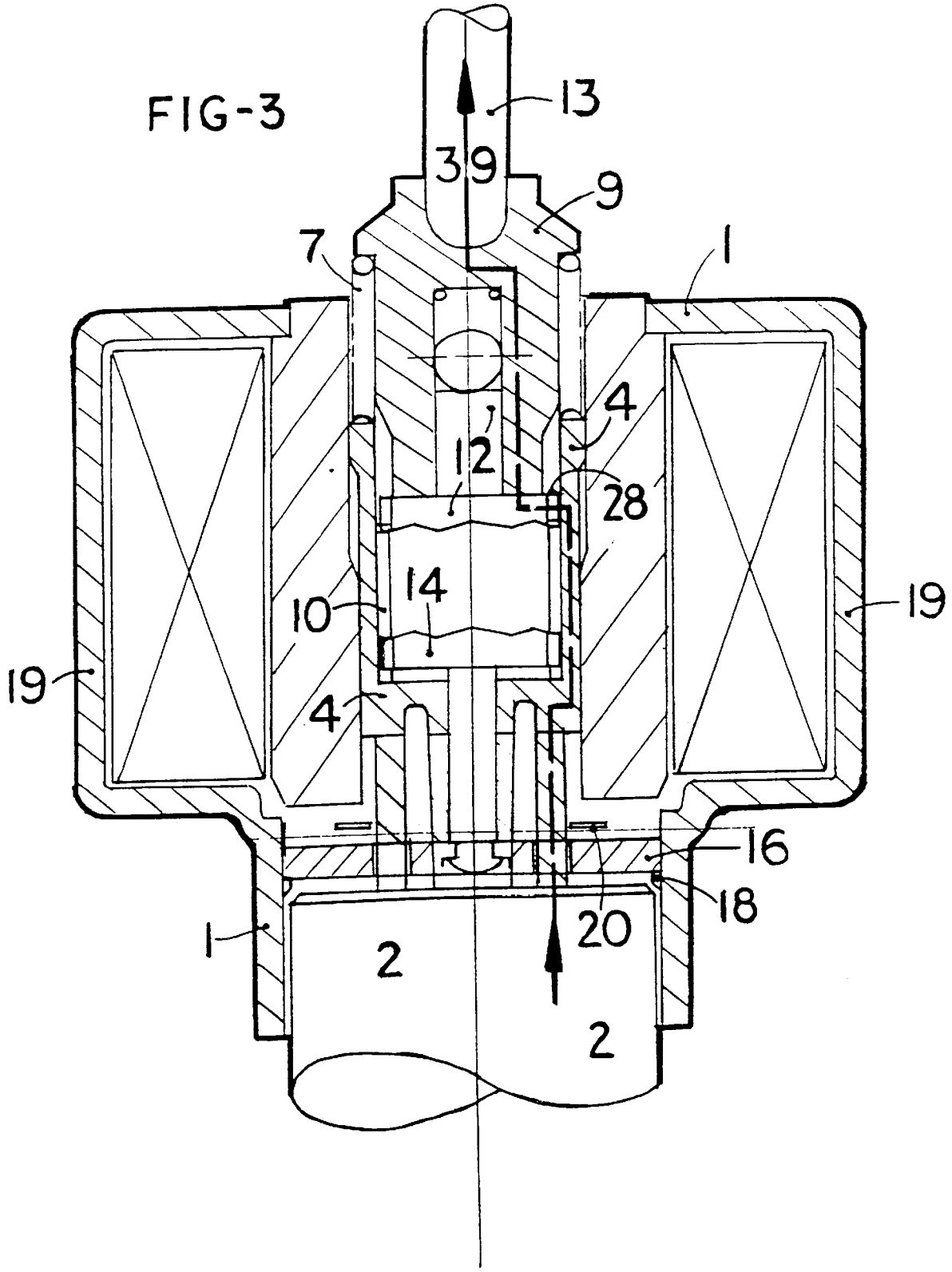
FIG. 3 is a cross section of the pulse drive valve deactivator showing the energy flow in the locked mode.
Figure 4:
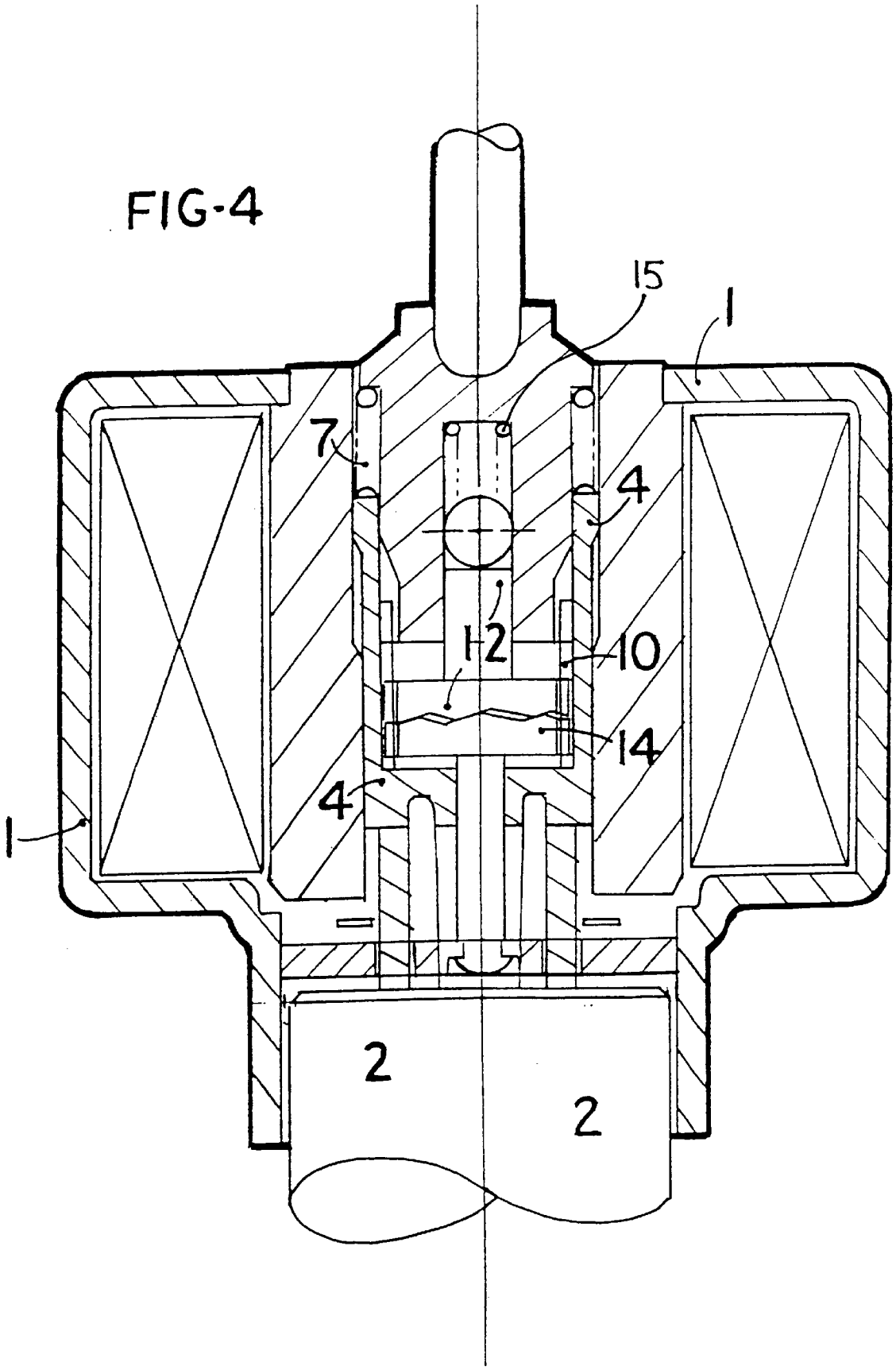
FIG. 4 is a cross section of the pulse drive deactivator showing the tappet in a high lift position working in the unlocked mode.

Referring to FIG. 3, the pulse drive valve deactivator 1 is shown functioning in a locked mode driving push rod 13. Wave spring 20 returns the armature 16 to a rest position against stop 18 of the solenoid frame 19. Tappet 2 is shown in a high lift position driving the key drive retainer 4 which is joined to the locking key 12 at connecting juncture 28 thereby activating push rod retaining socket 9. As the push rod retaining socket 9 is activated, push rod 13 is moved. (Energy flow is illustrated by arrow "39.") It should be appreciated that during the locked mode, the lost motion spring 7 is not compressed and the key drive retainer 4 slides along the key driver 14 along channel 10. Referring to FIG. 4, the pulse drive valve deactivator 1 is shown functioning in an unlocked mode with tappet 2 in a high lift position driving the key drive retainer 4 and compressing lost motion spring 7. It should be noted that the only parts in motion are the tappet 2 and key drive retainer 4 moving along fixed locking key 12 and key driver 14 at channel 10.

Figure 5:
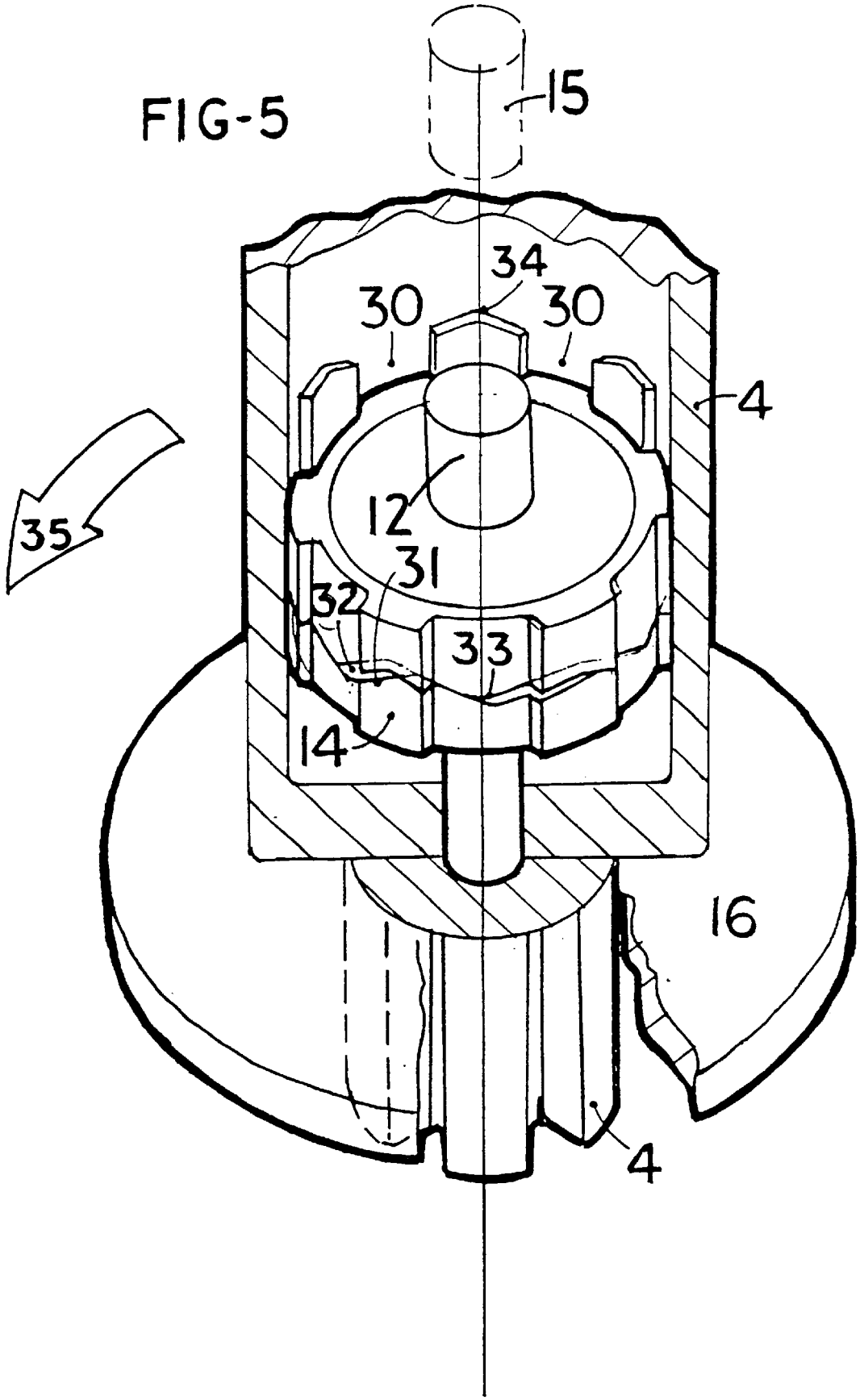
FIG. 5 is a cut-away perspective view illustrating the locking key in unlocked mode.
Figure 6:
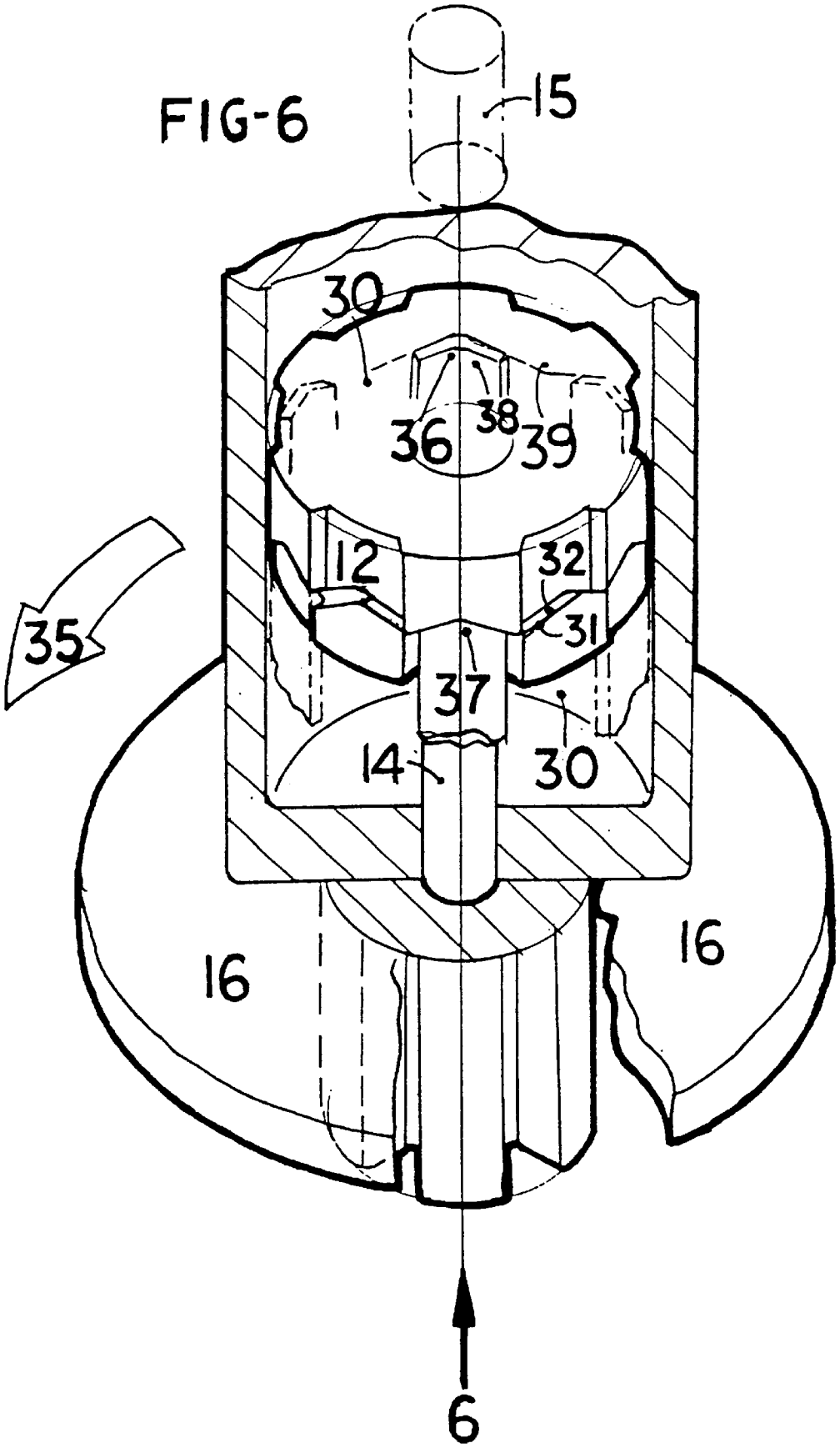
FIG. 6 is a cut-away perspective view illustrating the locking key in locked mode.

FIG. 5 provides a detailed illustration of the locking event. Locking key 12 is shown in an unloaded mode wherein key drive retainer 4 slides along locking key 12 along grooves 30. When the system is to be locked, the armature 16 moves the driver 14 in an upward direction which drives the locking key 12 along grooves 30. As spring 15 is compressed, torsional energy is stored promoting the locking key 12 to rotate because of the interface of slope 31 and space 32. This misalignment exists until locking key 12 is high enough wherein point 33 of locking key 12 is even with point "34" of key retainer 4. At this time, the locking key 12 is free of groove 30 and will start to index in the direction of arrow "35" because of the spring load, slope 31, and filling misalignment space 32 will excite locking key 12 to rotate to the locked position as shown in FIG. 6. It should be noted that the energy pulse applied by the armature 16 could also be supplied by other pulse energy activating devices including hydraulic, pneumatic, or mechanical actuator systems that can replace or be substituted for the armature and coil system. It is important to note that because of the torsional energy stored by spring 15, it is only an energy pulse that is required to engage the locking key.

Referring to FIG. 6, the locking event is a two-stage event because the timed solenoid energy pulse drives the locking key 12 out of groove 30 to begin rotation but energized spring 15 completes the locking/seating event, as the solenoid charge decays, forcing the locking key 12 to continue to rotate as point "39" of locking key 12 aligns with point "36" of the key drive retainer 4 completing rotation of the locking key 12 to a locked seated position as shown at position 37 and 38. It should be appreciated that when in the locked mode, spring 15 always loads the locking key 12 to the locked position 37 and 38 during camshaft base circle time duration.

To unlock the system, armature 16 strokes in the direction of arrow "6" driving the key driver 14 into the locking key 12 and compressing spring 15. At this time, misalignment at slope 31 and space 32 lifts and rotates the locking key 12 in the direction of arrow "35" over positions 37 and 38 propelling the locking key 12 down grooves 30 to the unlocked mode as shown in FIG. 5.

Figure 7:
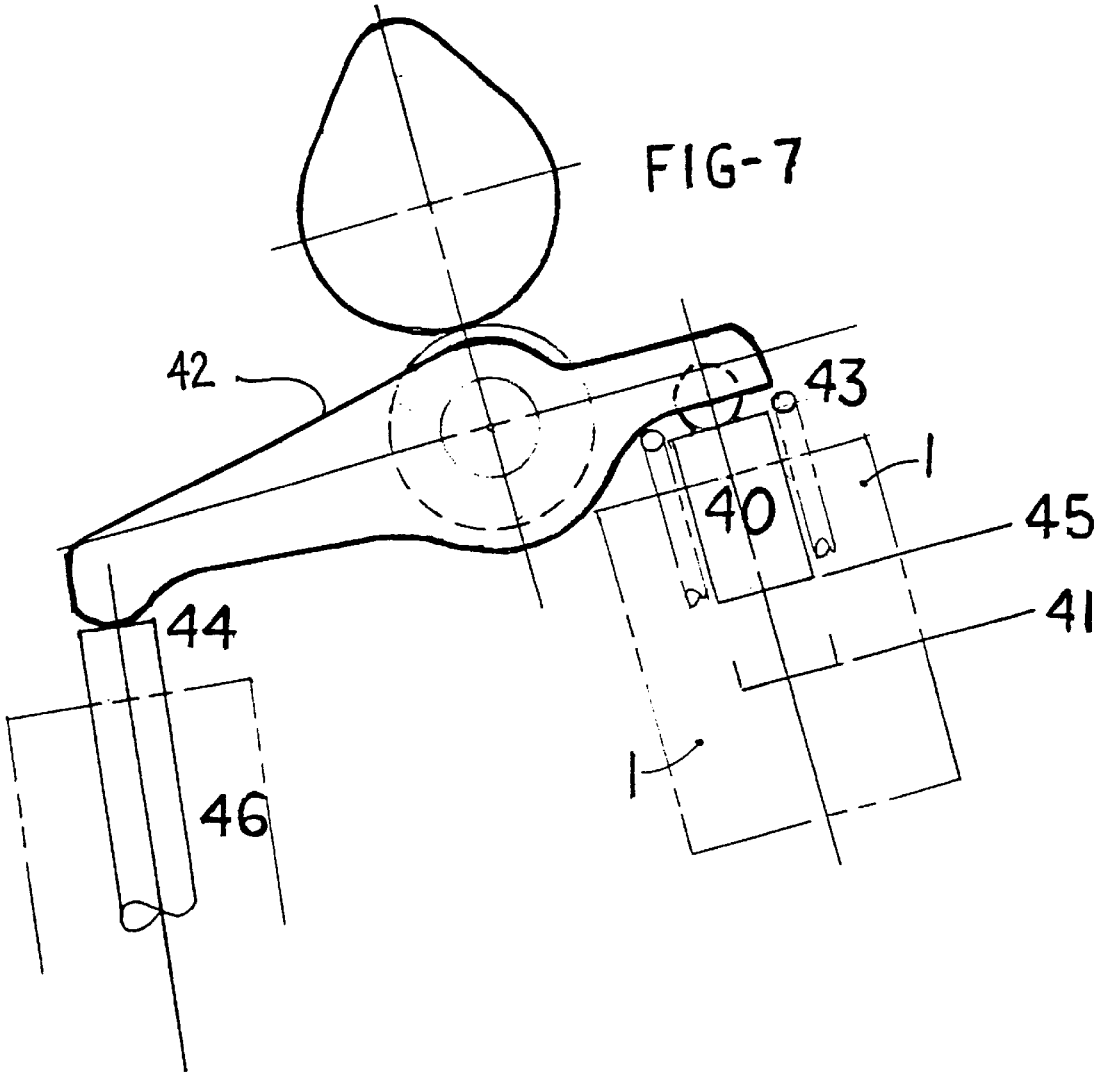
FIG. 7 is a side view of the pulse drive valve deactivator adapted to be used with a roller finger follower type overhead camshaft system.

FIG. 7 is a side view showing a roller finger follower (or end pivot rocker arm), pulse drive deactivator combination lash adjuster adapted to an overhead camshaft engine. The pulse drive deactivator 1 (shown in phantom) positions a lash adjuster 40 at a location 41 for a deactivated mode where rocker arm 42 rotates and compresses lost motion spring element 43. When valve 44 is to be activated, the pulse drive deactivator 1 cycles an energy pulse activating the locking key 12 moving the lash adjuster 40 to the valve drive location 45 wherein rocker arm 42 rotates to migrate valve 44 compressing valve spring 46 (shown in phantom).

The present invention has been described by text and images conveying a combination of conceptual ideas based on primary designs. It is to be understood that many evolutionary modifications and variations of the present invention are possible in light of the above description.

What is claimed is:

1. A valve deactivator, comprising:

a housing;

a coil supported in said housing;

an input member reciprocally supported by said housing and adapted to be driven by a reciprocating member;

an output member reciprocally supported by said housing;

an armature supported in said housing;

a drive member connected to said armature, said drive member having a first engagement surface;

a locking member slidably engaged with said input member and spring biased for movement relative to said output member, said locking member having a second engagement surface operably engageable by said first engagement surface of said drive member, wherein activation of said coil causes said armature to drive said drive member which drives said locking member relative to said input member toward said output member, said first and second engagement surfaces cooperate to index said locking member for inhibiting relative movement between said input and output members.

2. The valve deactivator according to claim 1, wherein said first and second engagement surfaces each include a sloped surface.

3. The valve deactivator according to claim 1, wherein said input member includes grooves which are engaged by said drive member and said locking member.

4. The valve deactivator according to claim 1, further comprising a spring between said input member and said output member.

5. The valve deactivator according to claim 1, wherein said output member includes bore for receiving a spring for providing a biasing force against said locking member.

6. The valve deactivator according to claim 3, wherein said locking member is disengaged with said grooves of said input member in order to allow indexing of said locking member.

7. The valve deactivator according to claim 1, wherein said armature is biased toward a first direction.

8. A valve actuator, comprising:

a tappet;

an input member in driving engagement with said tappet;

an output member;

a pushrod in driving engagement with said output member; and a locking assembly engageable for inhibiting relative movement between said input member and said output member, said locking assembly including a pulse energy activating device for engaging said locking assembly.

9. The valve actuator according to claim 8, wherein said pulse energy activating device includes a coil and armature system.

10. A valve actuator, comprising:

a cam drive member;

a pivotally mounted rocker in driving engagement with said cam drive member;

a lash adjuster member mounted in a housing and in driving engagement with said rocker, said lash adjuster member being spring biased against said rocker;

a valve member in driving engagement with said rocker; and a locking assembly engageable for inhibiting relative movement between said lash adjuster member and said housing, said locking assembly including a pulse energy activating device for engaging said locking assembly.

11. The valve actuator according to claim 10, wherein said pulse energy activating device includes a coil and armature system.

12. A valve deactivator, comprising:

a housing;

an input member reciprocally supported by said housing and adapted to be driven by a reciprocating member;

an output member reciprocally supported by said housing;

a drive member having a first engagement surface;

a locking member slidably engaged with said input member and spring biased for movement relative to said output member, said locking member having a second engagement surface operably engageable by said first engagement surface of said drive member; and a pulse energy activating device to drive said drive member wherein said first and second engagement surfaces cooperate to index said locking member for inhibiting relative movement between said input and output members.

13. The valve deactivator according to claim 12, wherein said pulse energy activating device includes a coil and armature system.

* * * * *